US010384867B2

(12) United States Patent
Jian

(10) Patent No.: US 10,384,867 B2
(45) Date of Patent: Aug. 20, 2019

(54) CONTAINER

(71) Applicant: SHANGHAI HONGYAN RETURNABLE TRANSIT PACKAGINGS CO., LTD, Shanghai (CN)

(72) Inventor: Yuanli Jian, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 0 days.

(21) Appl. No.: 15/739,879

(22) PCT Filed: Jun. 22, 2016

(86) PCT No.: PCT/CN2016/086735

§ 371 (c)(1),
(2) Date: Dec. 26, 2017

(87) PCT Pub. No.: WO2016/206586

PCT Pub. Date: Dec. 29, 2016

(65) Prior Publication Data

US 2018/0194553 A1 Jul. 12, 2018

(30) Foreign Application Priority Data

Jun. 25, 2015 (CN) ..... 2015 1 0359362

(51) Int. Cl.
*B65D 90/66* (2006.01)
*B65D 88/12* (2006.01)
(Continued)

(52) U.S. Cl.
CPC ..... *B65D 90/66* (2013.01); *B65D 19/06* (2013.01); *B65D 45/16* (2013.01); *B65D 45/20* (2013.01);
(Continued)

(58) Field of Classification Search
CPC ..... B65D 90/66; B65D 90/64; B65D 90/54; B65D 55/14; B65D 55/02; B65D 45/22;
(Continued)

(56) References Cited

U.S. PATENT DOCUMENTS 1,948,263 A * 2/1934 Green ..... B65D 45/24 220/326
2,903,151 A * 9/1959 Alcaro ..... A21B 3/135 220/23.2
(Continued)

FOREIGN PATENT DOCUMENTS

CN 201086935 Y 7/2008
CN 101342962 A 1/2009
(Continued)

OTHER PUBLICATIONS

International Search Report (English and Chinese) and Written Opinion issued in PCT/CN2016/086735 dated Sep. 30, 2016, 10 pages.

*Primary Examiner* — Robert J Hicks
(74) *Attorney, Agent, or Firm* — Hamre, Schumann, Mueller & Larson, P.C.

(57) ABSTRACT

A container comprises a base, side panels and a cover. The side panels are connected to the base. The cover is locked onto the tops of the side panels through a locking device. The locking device comprises automatic locks and manual locks. The automatic locks are arranged on two opposite sides of the cover, and the manual locks are arranged on the other two sides of the cover. The automatic locks and the manual locks are both adopted on the cover and used in cooperation with a tilting-prevention device, thus the container has the tilting-prevention effect, the stacking and supporting effect, and the locking and unlocking guiding and return guiding effect. The locking strength is increased, and the convenience in locking operation and unlocking operation is improved.

10 Claims, 11 Drawing Sheets

(51) Int. Cl.

| | |
|---|---|
| ***B65D 90/62*** | (2006.01) |
| ***B65D 19/06*** | (2006.01) |
| ***B65D 45/20*** | (2006.01) |
| ***B65D 45/16*** | (2006.01) |

(52) U.S. Cl.
CPC ..... *B65D 88/126* (2013.01); *B65D 90/626* (2013.01); *B65D 2255/00* (2013.01); *B65D 2519/00338* (2013.01); *B65D 2519/00711* (2013.01); *B65D 2519/00975* (2013.01); *B65D 2590/666* (2013.01)

(58) Field of Classification Search
CPC ..... B65D 45/16; B65D 21/0217; B65D 21/0222; B65D 21/0223; B65D 21/0219; B65D 21/022; B65D 21/0215; B65D 45/20; B65D 90/626; B65D 90/62; B65D 88/126; B65D 88/124; B65D 88/122; B65D 88/121; B65D 88/12; B65D 88/10; B65D 88/02
USPC ..... 220/1.5, 7, 6, 326, 324, 315; 206/508, 206/509, 510, 511; 292/257, DIG. 4
See application file for complete search history.

(56) References Cited

U.S. PATENT DOCUMENTS

| | | | | |
|---|---|---|---|---|
| 2005/0150892 | A1* | 7/2005 | Miller | B65D 19/18 220/324 |
| 2015/0150892 | A1* | 6/2015 | Jacks | G01N 33/57423 514/44 A |

FOREIGN PATENT DOCUMENTS

| | | | |
|---|---|---|---|
| CN | 104590787 | A | 5/2015 |
| CN | 104960813 | A | 10/2015 |
| CN | 204751106 | U | 11/2015 |
| JP | 2005231669 | A | 9/2005 |

* cited by examiner

CONTAINER

FIELD

The present invention relates to a logistics and warehousing field, specifically to a large container, and in particular to the large container with the volume above 800 L.

BACKGROUND

The large container (folded or unfolded structure) according to the present invention is a kind of logistics box, which has a volume of generally above 800 L, and is widely used in logistics transportation and warehouse storage in various industries. Larger containers with a volume greater than 800 L typically have higher mechanical requirements and more complicated load-bearing design than smaller capacity containers, such as containers with a volume smaller than 400 L.

Typically, the large container is provided with a protective cover, which can be locked and attached to side plates of the container box. When the container loaded with goods is transported, the cover can effectively improve the overall strength of the containers so as to ensure the safety of the goods within the containers during the transportation. And when the container loaded with goods is warehoused, the cover can well prevent the rainwater, dust, and other objects outside from entering into the containers, so as to protect a health environment for the storage of goods within the containers.

Furthermore, no matter in transport condition or in storage condition, and no matter whether the container is loaded with goods or not, the containers would be placed in stacking manner, that is, multiple containers are sequentially stacked up and down in layers in order to make full use of the container loading space. At this time, the cover plays an important role to connect the upper container and the lower container stacked. The stacking and connection effect of the cover is as follows: 1) the tilting-prevention effect: since the base of the upper container is placed on the cover of the lower container, the cover can ensure to define the relative position between the upper and lower container, and prevent the tilting of the stacked containers during the warehousing, in particular during the transportation; 2) stack bearing effect: when the cover of the upper container bears the gravity load of the upper container, the cover can effectively transfer the gravity load to the location where the lower container box can bear higher strength, for example the joint between two side plates of the container. Thus, a high demand on the structural design of the container cover is made.

There exists a large container, and the container cover is provided with a tilting-prevention device, which is located in a middle area within the sides of the cover. The cover usually adopts plastic sheet structure. The cover of the lower container sometimes is recessed under the pressure of the upper container box. In this time, the tilting-prevention on the cover will be recessed together along the middle area, the tilting-prevention device detaches from the bottom of the upper container box, thereby invalidating the tilting-prevention effect of the tilting-prevention device. In addition, a manual lock is provided on the side of the cover. The manual lock is prone to be damaged after being repeatedly used for many times. Furthermore, tilting-prevention device is located in the middle area within the sides of the cover, which results in multiple covers as separate parts that cannot be securely stacked together for transport and storage.

There exists another large container, which has a cover provided with two manual locks on each side thereof. Although more manual locks can enhance the locking effect, the operation is very cumbersome.

The position of the tilting-prevention device provided on the cover of the large container can be concluded into two places, one is the middle area within the sides of the cover, and the other is the corner on the side of the cover. In addition, if the two opposite sides of the cover of the container are shorter, the two opposite sides may be provided only one tilting-prevention device, which leads the tilting-prevention effect to be likely not ideal, or if the two opposite sides are provided with two tilting-prevention devices respectively, it will appear a little crowded and not beautiful.

SUMMARY

The technical problem to be solved by the present invention is to provide a large container with the volume generally above 800 L. Two opposite sides of the cover of the container are provided with automatic locks and other two sides are provided with manual locks. The manual locks assist automatic lock to lock the cover on the top of the side plates therefore enhancing locking strength, simultaneously improve convenience of the locking operation and unlocking operation.

To solve the above technical problem, the present invention adopts the following solutions:

A container, comprising a base, side plates connected to the base and a cover, wherein the cover is configured to be locked onto the tops of the side plates through a locking device comprising automatic locks and manual locks, and the automatic locks are provided on two opposite sides of the cover, and the manual locks are provided on other two sides of the cover.

In a preferred embodiment, the automatic locks and adjacent manual locks of the automatic locks can be connected to each other by line to form a polygon shape whose adjacent side lengths are presented by A and B respectively, and $A \leq B \leq 1.5\ A$.

In another preferred embodiment, the automatic locks and the adjacent manual locks can be connected to each other and connected with side of the cover by line to form a polygon shape whose adjacent side lengths are presented by C and D respectively, and $C \leq D \leq 1.5\ C$.

In a preferred embodiment, the automatic locks 50 and the adjacent manual locks 60 are connected to each other by line to form a quadrilateral shape. And the internal angle of the quadrilateral shape may range from 60 degrees to 120 degrees.

Preferably, each of two opposite sides of the cover is provided with an automatic lock and each of the other two sides is provided with a manual lock.

In another preferred embodiment, the automatic locks and the adjacent manual locks are connected to each other and connected with the side of the cover by line to form a hexagon shape. And the internal angle of the hexagon shape may range from 90 degrees to 150 degrees.

Preferably, each of two opposite sides of the cover is provided with two automatic locks and each of the other two sides is provided with one manual lock.

In another preferred embodiment, the automatic lock and the adjacent manual lock are connected to each other and connected with four sides of the cover by line to form an octagon shape. And the internal angle of the octagon shape may range from 105 degrees to 165 degrees.

Preferably, each of two opposite sides of the cover is provided with two automatic locks and each of the other two sides is provided with two manual locks.

In a preferred embodiment, the cover is further provided with a tilting-prevention device, and the tilting-prevention device is provided on the side of the cover avoiding the corner of the cover.

In a preferred embodiment, the cover is further provided with a tilting-prevention device, and the tilting-prevention device comprises multiple protrusions integrally extending upward from the sides of the cover, and the base is provided with recesses cooperating with the protrusions.

In a preferred embodiment, one or more of the multiple protrusions is provided with the automatic lacks and the manual locks.

In a preferred embodiment, the manual locks are provided with a locking member and a guiding device, and the locking member can be guided by the guiding device, so as to achieve locking or unlocking.

In a preferred embodiment, the other two sides of the cover are further provided with bosses, and the manual locks are provided on the bosses, and lower surface of the base is provided with grooves cooperating with the bosses.

In a preferred embodiment, the guiding device comprises a slide step, and the bosses are provided with a sliding groove cooperating with the slide step, so that the slide step can be slidably mounted in the sliding groove.

In another preferred embodiment, the guiding device comprises a pin, and the bosses are provided with a rotation hole, and the pin can be rotartablely connected to the rotation hole.

In a preferred embodiment, the locking member is provided with a locking hook, and the side plates are provided with a hook groove, and the locking hook can be locked and connected to the hook groove; two sides of the manual locks are further provided with side arms, and one end of the side arms is provided with a locking block, and a first locking slot and a second locking slot are provided on two sides of the boss, and the locking block can be snapped in the first locking groove and the second locking groove so as to respectively achieve unlocking position and locking position.

In a preferred embodiment, the automatic locks comprise a handle, and the handle is further provided with a resetting member, and the upper side of the cover is provided with a handle groove, and the handle is accommodated in the handle groove and the resetting member is elastically connected to a side wall of the handle groove.

In a preferred embodiment, the handle is provided with a connecting hole, and the handle groove is provided with a connecting shaft, and the connecting shaft can be rotartablely connected to the connecting hole.

In another preferred embodiment, the handle is provided with a hook, and the handle groove is provided with a hanging platform, and the hook can mounted in the hanging platform and can slide along the hanging platform.

In a preferred embodiment, the handle is further provided with a pin member, and the automatic locks further comprise a latch, and the latch is provided with a guide track, a pin hole and a buckle position, the side plates are provided with a buckle groove, and the pin member can be cooperatively connected to the pin hole, and the buckle can be locked and connected to the buckle groove; and the sides of the cover are provided with a guide groove, and the slide can be slidably mounted in the guide groove.

In a preferred embodiment, the volume of the container of the present invention is above 600 L, more preferably above 700 L.

The invention has the following beneficial effects:

1. The container according to the present invention is provided with automatic locks provided on the opposite two sides of the cover and manual locks provided on the other two sides of the cover. When performing the unlocking operation, the manual locks are firstly unlocked, and then the automatic locks rare unlocked, so that one operator can easily unlock it.

2. On the basis of the container according to the present invention simultaneously provided with manual lock and automatic lock, position of locking devices are arranged in a form of quadrilateral, hexagon or octagon (preferably, regular tetragon, regular hexagon or regular octagon) shape so that the container has a better locking strength, to prevent the goods from spilling due to the deformation of the cover.

3. The tilting-prevention device of the container according to the present invention is provided on the side of the cover and avoid corner of the cover so as to enhance the stack bearing capability of the container. The arrangement that the tilting-prevention device is provided on the sides of the cover can further prevent the failure of the tilting-prevention effect due to the cover deformation.

4. The manual locks of the container according to the present invention are provided on bosses, the combination of the bosses and the tilting-prevention device can have both locking and tilting-prevention functions.

5. The manual lock of the container according to the present invention is provided with a guiding device, the locking member can realize locking and unlocking under the guidance of the guiding device, the locking and unlocking operation is more convenient and the manual lock is hard to be damaged. The locking block of the manual locks cooperates with the locking slot on the bosses, so that the manual locks can be reliably located in a locked or unlocked state.

DETAILED DESCRIPTION OF EMBODIMENTS

Figure 1:
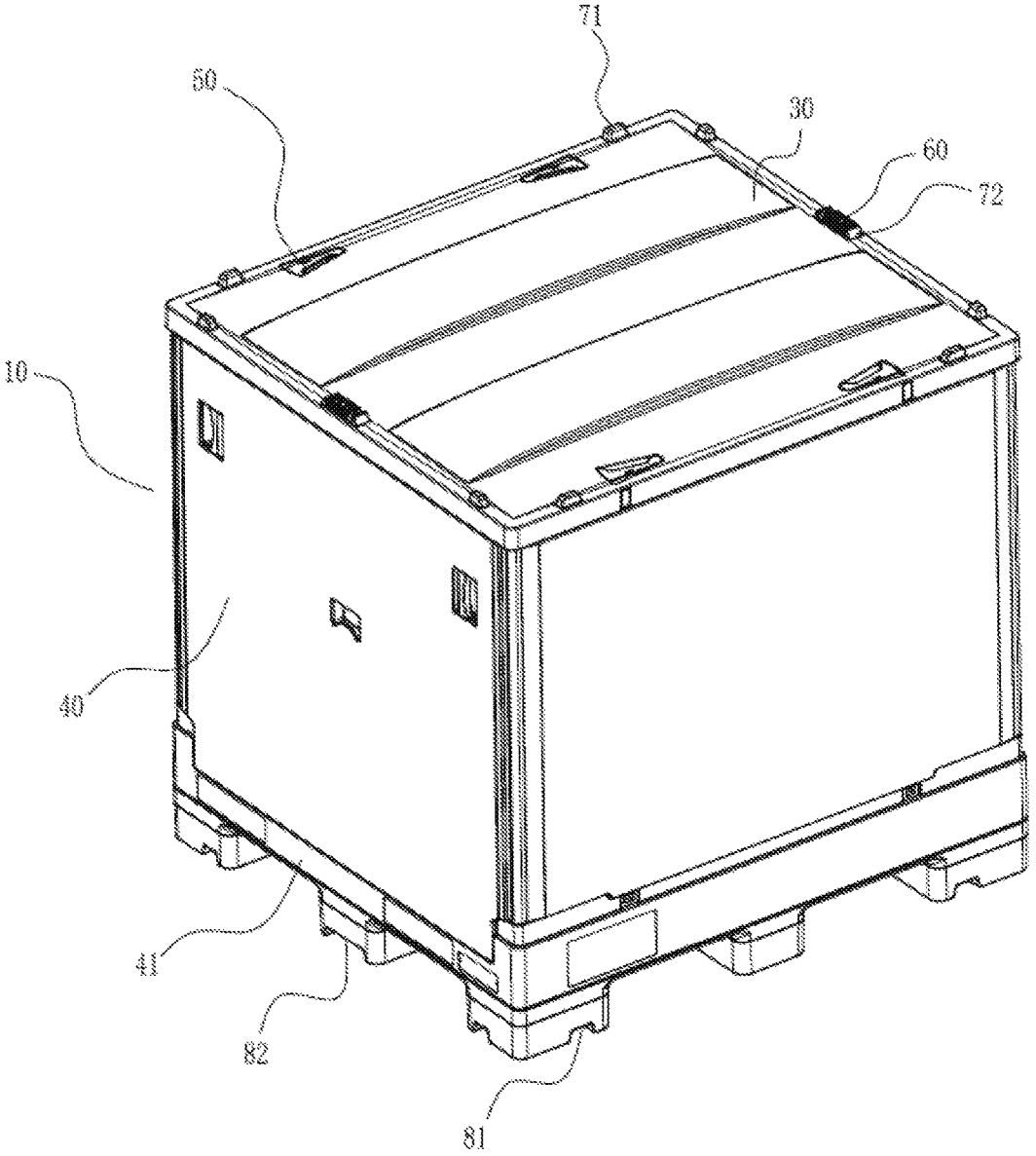
FIG. 1 is a perspective view of a container in a locked state according to a first embodiment of the present invention.
Figure 2:
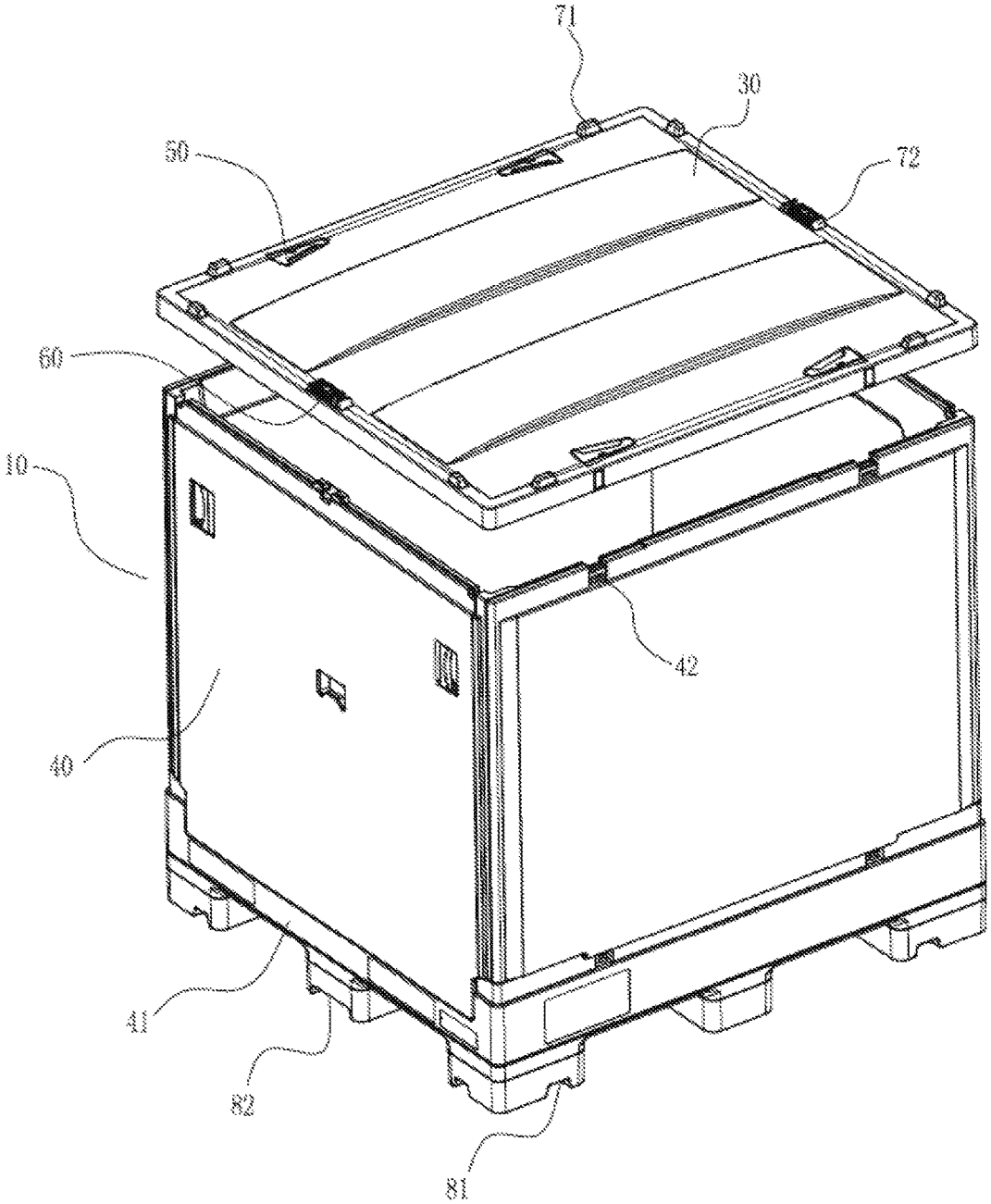
FIG. 2 is a perspective view of a container in an unlocked state according to the first embodiment.

The preferred embodiments of the present invention will be described in detail below with reference to the accompanying drawings in order to understand the purpose, features and advantages of the present invention more clearly. It should be understood that the embodiments shown in the drawings are not intended to limit the scope of the present invention, but merely illustrate the spirit of the technical solution of the present invention.

Explanation of Terms

Automatic lock: the automatic lock herein refers to such a locking device that the automatic lock starts to move from its initial position by triggering the handle, and after the automatic lock is unlocked, the handle can be automatically returned to the initial position by releasing the handle.

Large container: the large container herein refers to a container comprising a base, four side plates and a cover, with the volume generally above 600 L, in particular above 800 L.

The First Embodiment

FIG. 1 shows a container 10 having a volume of generally above 800 L according to the first embodiment of the present invention. With reference to FIGS. 1-10, the container 10 comprises a cover 30, side plates 40 and a base 41, wherein the side plates 40 connect with the base 41 and form a box portion of the container. The side of the cover 30 is provided with a tilting-prevention device and a locking device.

Figure 3A:
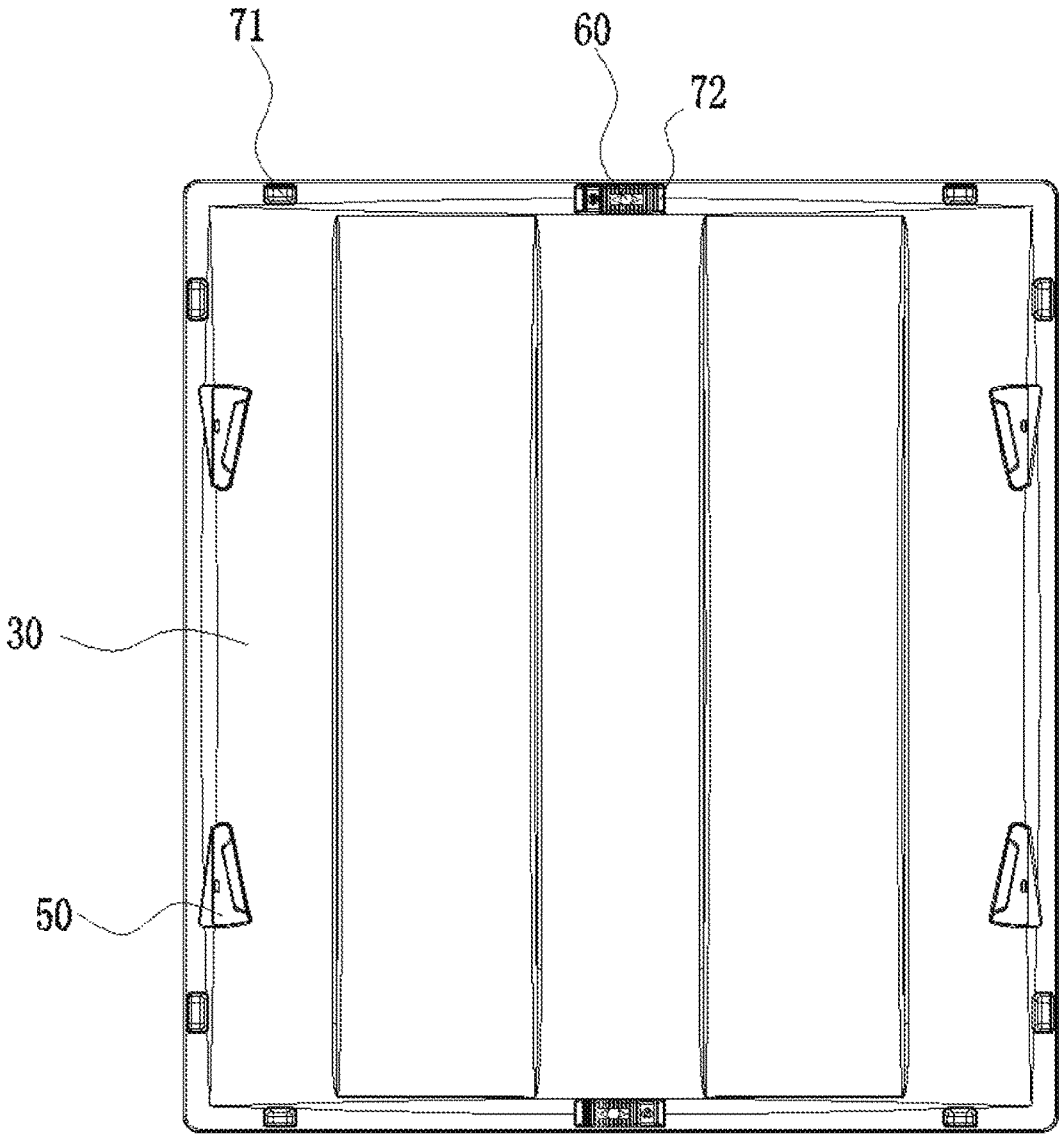
FIG. 3*a* is a top view of the cover of the container according to the first embodiment.

The locking device comprises an automatic lock 50 and a manual lock 60. FIG. 3*a* shows the cover according to the first embodiment, and each of two opposite sides of the cover 30 is provided with two automatic locks 50 and each of the other two sides are provided with one manual lock 60.

FIG. 3*a* shows that the automatic locks 50 and adjacent manual locks 60 are connected to each other and connected with two sides of the cover to form a hexagon shape. The internal angle of the hexagon shape may range from 90 degrees to 150 degrees. Preferably, the internal angle of the hexagon range from 100 degrees to 130 degrees. More preferably, the internal angles of the hexagon are all 120 degrees. At this time the automatic locks 50 and the adjacent manual locks 60 are connected to each other and connected with the two side of the cover to form a regular hexagon shape.

Figure 3B:
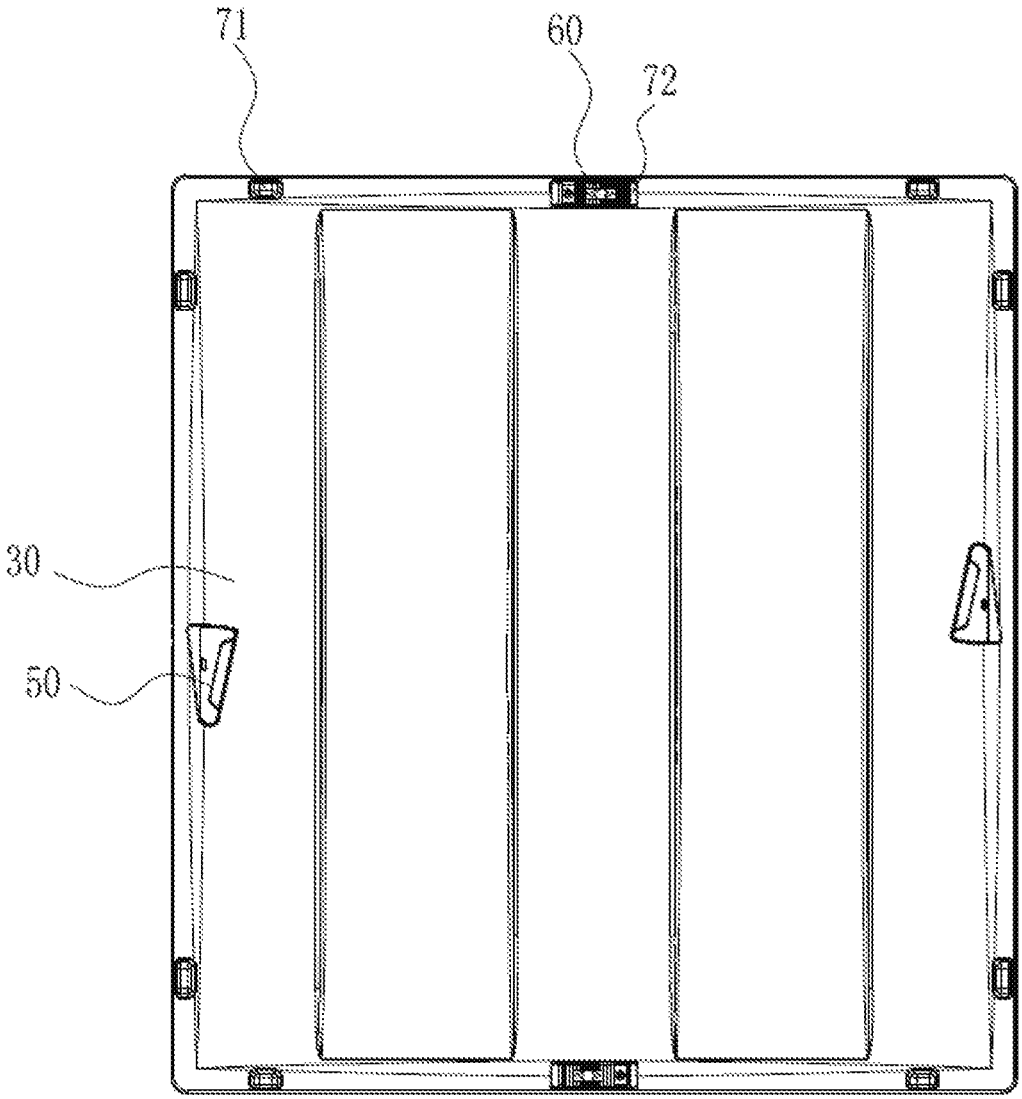
FIG. 3*b* is a top view of a variant of the cover of FIG. 3*a;*

FIG. 3*b* shows a variant of the cover of FIG. 3*a*, wherein each of two opposite sides of the cover 30 is provided with one automatic lock 50 and each of the other two sides is provided with one manual lock 60. FIG. 3*b* shows that automatic locks 50 and adjacent manual locks 60 are connected to each other to form a quadrilateral shape. The internal angle of the quadrilateral shape may range from 60 degrees to 120 degrees. Preferably, the internal angle of the quadrilateral shape range from 70 degrees to 110 degrees. Preferably, the internal angles of the quadrilateral are all 90 degrees. At this time the automatic locks 50 and adjacent manual locks 60 are connected to each other to form a regular quadrilateral shape.

Figure 3C:
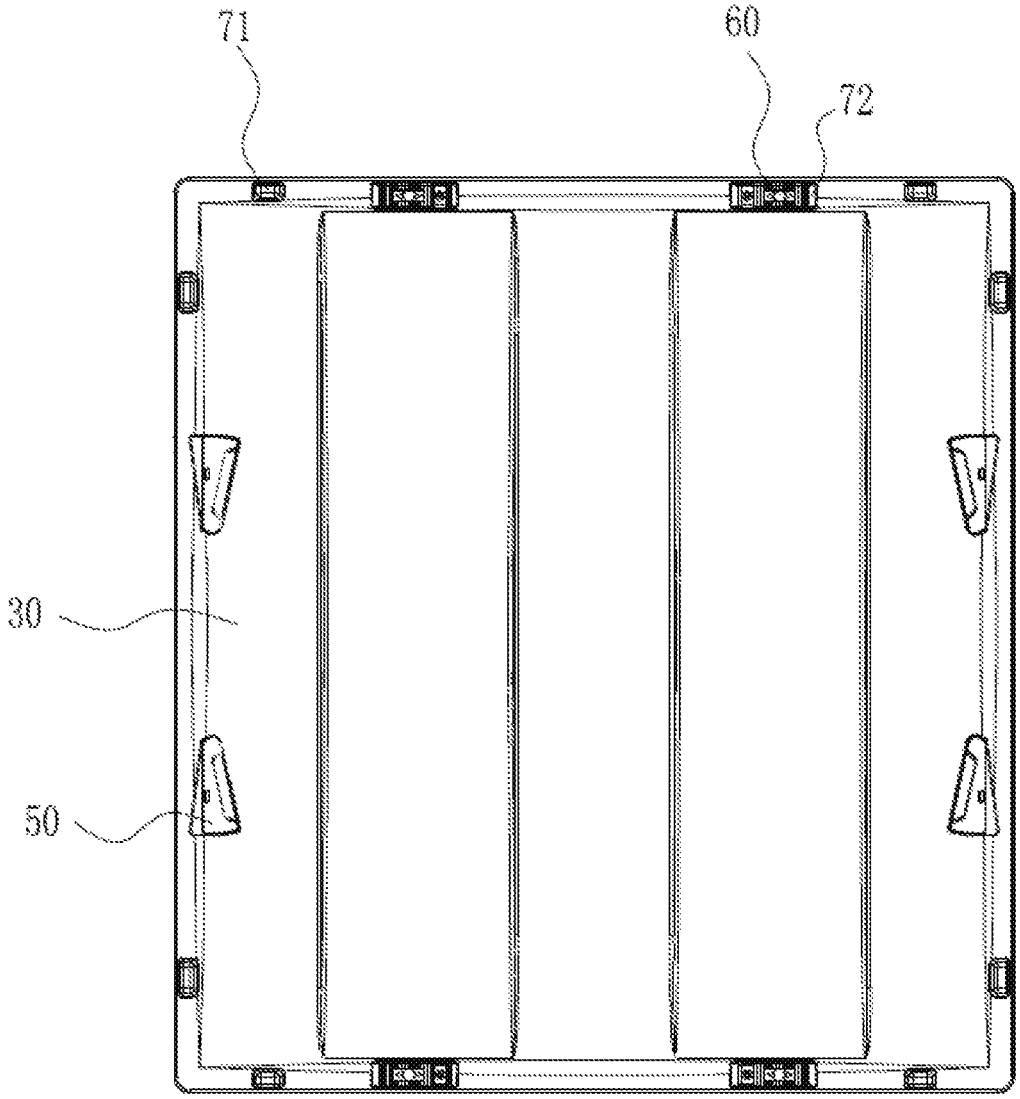
FIG. 3*c* is a top view of another variant of the cover of FIG. 3*a;*

FIG. 3*c* shows another variant of the cover of FIG. 3*a*, wherein each of two opposite sides of the cover 30 is provided with two automatic locks 50 and each of the other two sides is provided with two manual locks 60. FIG. 3*b* shows that the automatic locks 50 and the adjacent manual locks 60 are connected to each other and connected with four sides of the cover to form an octagon shape. The internal angle of the octagon shape may range from 105 degrees to 165 degrees. Preferably, the internal angle of the octagon shape range from 120 degrees to 150 degrees. Preferably, the internal angles of the octagon shape are all 135 degrees. At this time the automatic locks 50 and the adjacent manual locks 60 are connected to each other and connected with the four sides of the cover to form a regular octagon shape.

In the other embodiment of the cover (not shown), depending on the different number of the automatic locks and the manual locks provided on the sides of the cover, the automatic locks and the manual locks can still be arranged in a quadrilateral, a hexagonal or an octagonal shape. Preferably, the automatic locks and the manual locks can be arranged in a regular quadrilateral, a regular hexagonal or a regular octagonal shape. The preferred arrangement of the regular polygon is such that the locking devices provided on the sides of the cover 30 achieve a better locking strength so that the cover 30 are securely locked to the side plates 40.

In addition, the automatic locks and the adjacent manual locks can be connected to each other to form a polygon shape with two adjacent sides having lengths A and B respectively, and $A \leq B \leq 1.5$ A. Alternatively, the automatic locks and the adjacent manual locks can be connected to each other and connected with at one side of the cover to form a polygon shape with two adjacent sides having lengths C and D respectively, and $C \leq D \leq 1.5$ C. This structural design can avoid the risk of goods spilled due to the unreasonable position arrangement of the automatic lock and the manual lock.

The number of the automatic lock and the manual lock can be selected depending on the required locking strength in actual use, wherein the embodiment in which two automatic locks 50 are provided on each of the two opposite sides of the cover 30, and one manual lock 60 provided on each of the other two sides is a more preferred.

The tilting-prevention device is provided on the side of the cover 30 and avoids the corner of the cover 30. Avoiding the corner of the cover 30 refers to the structure of the tilting-prevention device does not extend to or touch the corner of the cover 30, so that the bottom of the upper container has direct contact to the corner of the cover of the lower container upon stacking.

The tilting-prevention device in various embodiments of the present invention comprises multiple protrusions 71 extending upward integrally from the side of the cover, and the base 41 is provided with a recess 81 cooperating with the protrusions 71. When two containers are stacked, the protrusions 71 of the lower container are embedded in the recess 81 of the upper container. One protrusion 71 of the lower container and one recess 81 of the upper container form a group of tilting-prevention combination. Due to the side wall provided on one side of the recess 81, the cooperation of the multiple tilting-prevention combinations can not only prevent the upper container from lateral moving with respect to the lower container, but also prevent the upper container form falling toward sideways.

On the other hand, as shown in Figures of the present embodiment, tilting-prevention device is located between the automatic lock 50 and the manual lock 60, and two protrusions 71 is provided between the two adjacent automatic lock 50 and the manual lock 60 and are respectively provided on the two sides of the cover 30. Assuming that the side of the cover 30 have a length B, the distance A between the protrusion 71 and the corner of the adjacent cover 30 may be provided as $B/10 \leq A \leq B/3$, preferably, $B/5 \leq A \leq B/4$. The tilting-prevention device adopts such a position arrangement way of avoiding the corner of the cover 30, so that the gravity of the stacked upper container can be prior transferred to the connecting portion of the two side plates 40 of the lower container via the cover 30 of the lower container. The connecting portion has better load-bearing strength and support stability, thereby improving the overall bearing capacity of the lower container.

The middle portion of side of the cover 30 provided with the manual lock 60 is provided with a boss 72, and the manual lock 60 is provided on the boss 72. The boss 72 can serve as a part of the tilting-prevention device to assist to achieve the tilting-prevention function. The lower surface of the base 41 is provided with a groove 82 matching with the boss 72. In the present embodiment, the boss 72 can prevent the upper container from lateral moving or falling toward sideways when the manual lock 60 provides a locking function. That is, one boss 72 of the lower container and one groove 82 of the upper container can form another type of group of tilting-prevention combinations.

The container of the present invention is simultaneously provided with automatic locks 50 and manual locks 60. And the automatic locks 50 are provided on the opposite two sides of the cover, and the manual locks 30 are provided on the other two sides of the cover 30. This position selection and structure design of the locking device is different from the existing design practice of providing only manual lock or automatic lock on the cover of the container, so as to facilitate the unlocking and locking operation. The design of providing the automatic locks on the opposite sides enables the operator to open the cover of the container on one side and unlocking and locking operation can be completed by just one operator. For example, when performing the unlocking operation of the container according to the present invention, after the manual lock 60 is unlocked, the automatic lock 50 can be conveniently unlocked and the cover 30 is opened. In addition, the manual lock 60 on the boss 72 assists the automatic lock 50 to lock the container, and the manual lock 60 and the boss 72 formed as a whole, which is another form of the tilting-prevention combination, may also assist the tilting-prevention device in preventing the upper container from lateral moving or falling toward sideways. Such a one-piece and multi-purpose structural design of the manual lock 60 and the boss 72 makes the surface structure of the cover 30 to be more cleanly arranged and save material and manufacturing cost.

Figure 4:
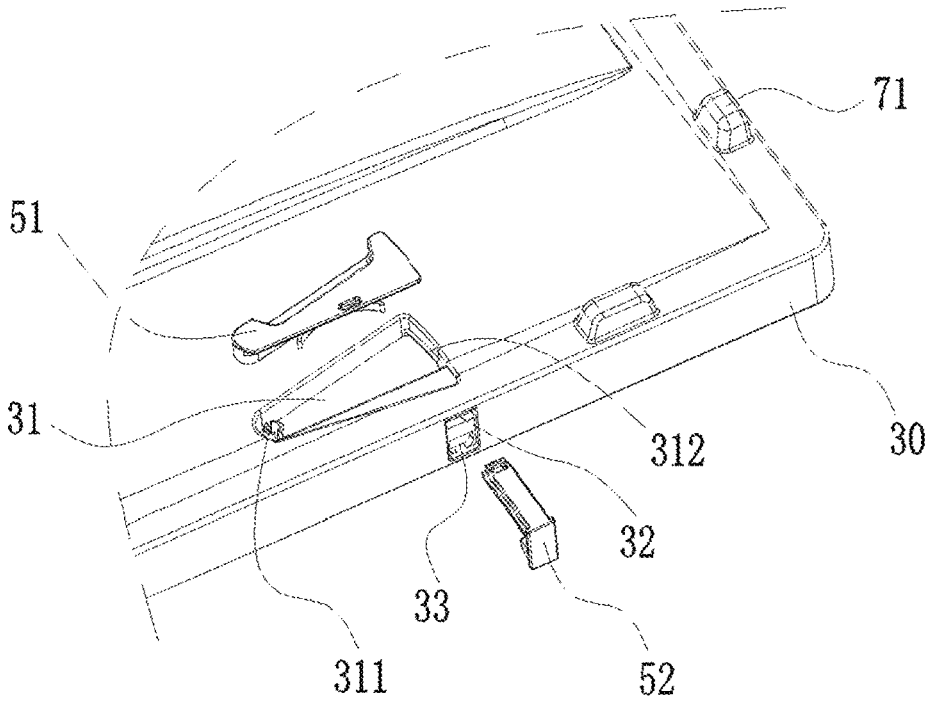
FIG. 4 is a partially exploded schematic view of a cover with automatic lock according to the first embodiment.
Figure 5:
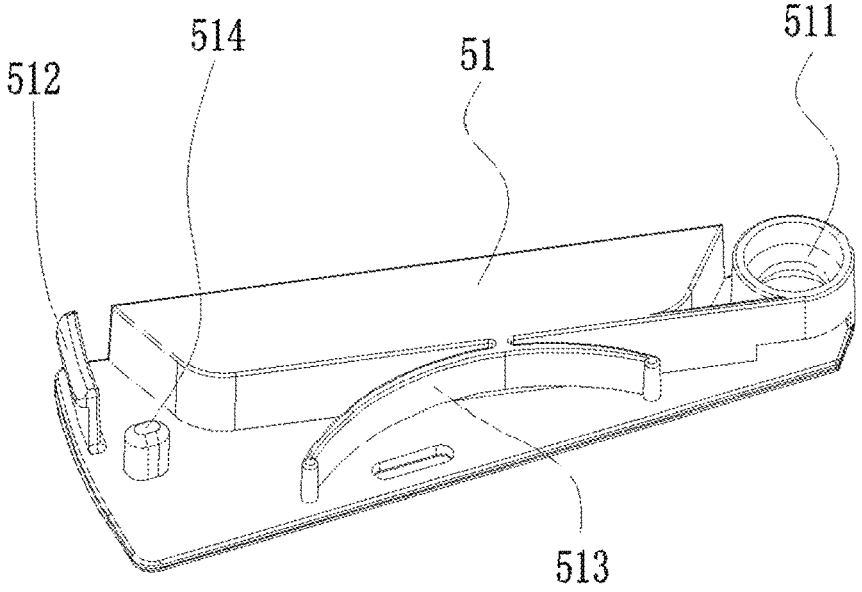
FIG. 5 is a perspective view of a handle of the automatic lock of the container according to the first embodiment.
Figure 6:
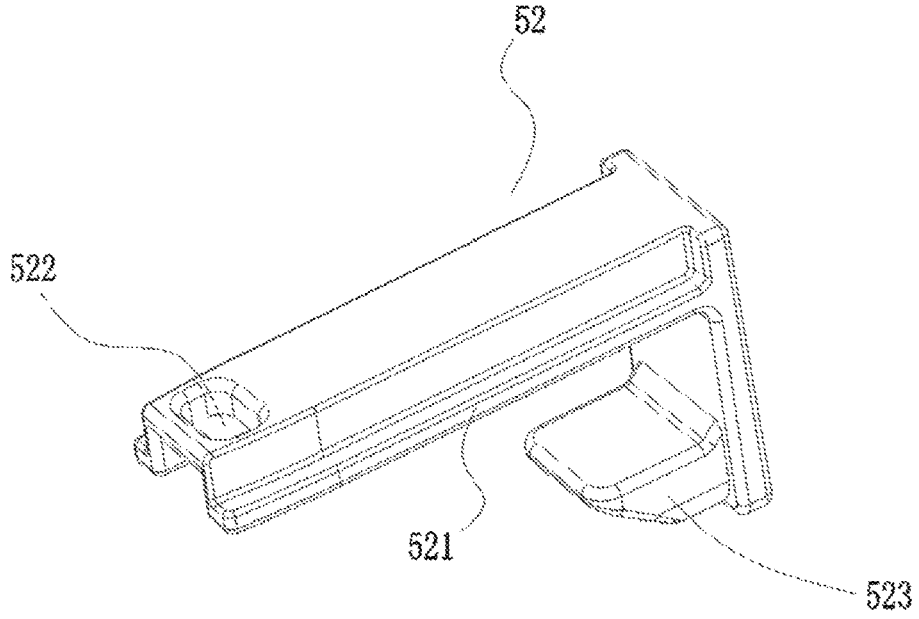
FIG. 6 is a perspective view of a latch of the automatic lock of the container according to the first embodiment.

With reference to FIGS. 4-6, the automatic lock 50 comprises a handle 51 and a latch 52, and a handle groove 31 is provided on the upper surface of the cover 30 to cooperate with the handle 51. Both the handle 51 and the handle groove 31 have a substantially fan shape. A connecting hole 511 is provided on the narrower end of the handle 51, and a connecting shaft 311 matching with the connecting hole 511 is provided in the handle groove 31. The connecting shaft 311 is rotatably connected to the connecting hole 511 so that the handle 51 can be rotated in the handle groove 31 within a small range. A hook 512 is provided on the wider end of the handle 51, and the hanging platform 312 matching with the hook 512 is provided in the handle groove 31 and the hook 512 is slidably mounted on the hanging platform 312. Furthermore, the handle groove 31 defines the rotatable range of the handle 51, the connecting hole 511 and the connecting shaft 311 as a combination to guide the handle 51, and the hook 512 and hanging platform 312 as a combination to assists to guide the handle 51.

The handle 51 is further provided with a resetting member 513, the resetting member 513 is elastically connected to the side wall of the handle groove 31. The resetting member 513 may be in forms of an elastic metal sheet structure, and other elastic structural forms, such as spring, can also be adopted. In the present embodiment, the resetting member 513 abuts against the side wall of the handle groove 31, and when a force is applied on the handle 51, the resetting member 513 is pressed to be elastically deformed. After the force is removed, the resetting member 513 can recover its original shape relying on its own elasticity so that the handle 51 returns to the initial state.

The latch 52 is provided with a guide track 521, a pin hole 522 and a buckle 523. The side of the cover 30 is provided with a guide groove 32, and the guide track 521 is slidably mounted in the guide groove 32. The latch 52 can be unlocked or locked under guidance of the guide track 521. The handle 51 is further provided with a pin member 514, the pin hole 522 is located on one end of the latch which firstly comes into the interior of the box, and the pin member 514 can be cooperatively connected to the pin hole. The side plate 40 is provided with a buckle groove 42 matching with the buckle 523, and the buckle 523 can be locked and connected to the buckle groove 42. When the buckle 523 is passed through the side hole 33 of the cover 30 and locked in the buckle groove 42, the automatic lock 50 is in a locked state, in which the automatic lock 50 locks the cover 30 on the side plate 40.

When the buckle 523 is locked in the buckle groove 42, the end surface of the latch 52 towards the outside of the box is flush with the side surface of the cover 30. After the pin member 514 is inserted into the pin hole 522, the handle 51 can drive the latch 52 to move together. For example, when performing the unlock operation of the automatic lock 50, the buckle 523 detaches from the buckle groove 42 by triggering the handle 51, thereby unlocking. When performing the lock operation of the automatic lock 50, the buckle 523 can be pushed into the buckle groove 42 by applying force on the end surface of the latch 52 towards outside of the box, thereby locking.

With reference to the FIGS. 7-10, the manual lock 60 is provided with a locking member, a guiding device and an upper arm 64. The locking member can be guided by the guiding device, so as to achieve locking or unlocking. The guiding device comprises a sliding step 62, and the boss 72 is provided with a sliding groove 72 matching with the slide step 62, so that the slide step 62 can be slidably mounted in the slide groove 721. The locking member is provided with a locking hook 63, and the side plate 40 is provided with a hook groove 43. The locking hook 63 can be locked in the hook groove 43.

Side arms 61 are provided on both sides of the manual lock 60, and a locking block 611 is provided on the end of the side arm 61. A first locking slot 721 and a second locking slot 722 are provided on two sides of the boss 72. The locking block 611 can be snapped in the first locking groove 721 and the second locking groove 722 so as to respectively achieve unlocking position and locking position. When the manual lock 60 is placed on the boss 72, the locking hook 63 is firstly placed in the wider end of the sliding groove 721 until the locking block 611 is snapped in the first locking slot 722. During the placing process, both the side arm 61 and the upper arm 64 will be forced to bend slightly toward the outside to complete the placing process. When performing the locking operation of the manual lock 60, the locking hook 63 is pushed from the wider end of the gliding groove 721 to the narrower end of the sliding groove 721 until the locking block 611 is snapped into the second locking slot 723. At this time, the locking hook 63 is locked in the hook groove 43 so as to complete the locking operation of the manual lock 60.

The locking hook 63 of the manual lock 60 and the hook groove 43 of the side plate 40 are respectively provided with the corresponding guiding inclined surfaces which are respectively the first guiding inclined surface 66 and the second guiding inclined surface 44. The first guiding inclined surface 66 and the second guiding inclined surface 44 are cooperated to each other to facilitate the placing process of the manual lock 60, and the manual lock is guided into the state of which will be locked.

The manual lock 62 with guiding device can be locked as needed and can be conveniently unlocked or locked when the container is used for storage, regardless of the initial state of the manual lock 62. When the container is used for transportation, the manual lock 60 is manually operated to lock, and assist the locked automatic lock 50 to lock the cover 30 on the side plate 40 so as to improve the lock strength.

The Second Embodiment

Figure 11:
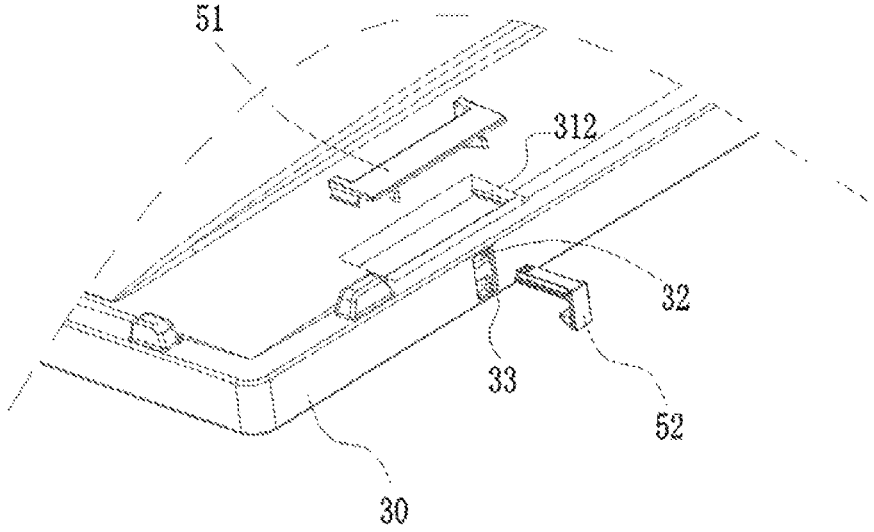
FIG. 11 is a partially exploded schematic view of the portion of the container cover provided with automatic lock portion according to the second embodiment.
Figure 12:
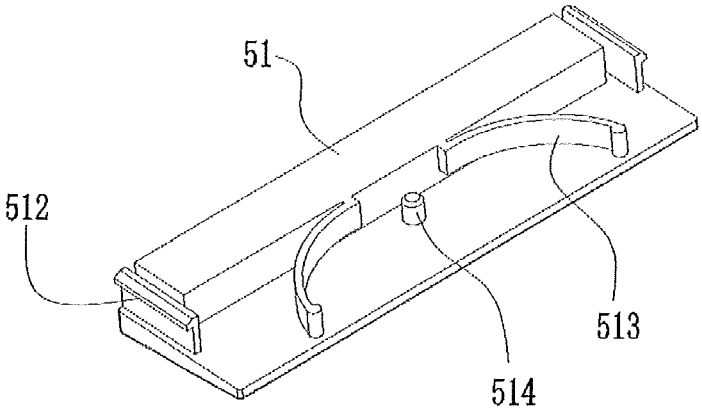
FIG. 12 is a perspective view of a handle of the automatic lock of the container according to the second embodiment.

With reference to FIG. 11 and FIG. 12, the second embodiment of the container according to the present invention is shown in figures. In the present embodiment, the handle 51 and handle groove 31 of the automatic lock both have a rectangular shape, and the handle 51 is provided with a straight hook 512, and a straight hanging platform 312 is provided in the handle groove 31, and the hook 512 is mounted on the hanging platform 312 and can slide along the hook 512.

In the first embodiment, the combination of the connecting hole 511 and the connecting shaft 311, shown in FIG. 4 and FIG. 5, provides a circumferential rotation guide for the return action of the automatic lock. In the second embodiment, the combination of the hook 512 and the hanging platform 312, shown in FIG. 11 and FIG. 12, provides a linear translation guide for the return action of the automatic lock.

The Third Embodiment

Figure 13:
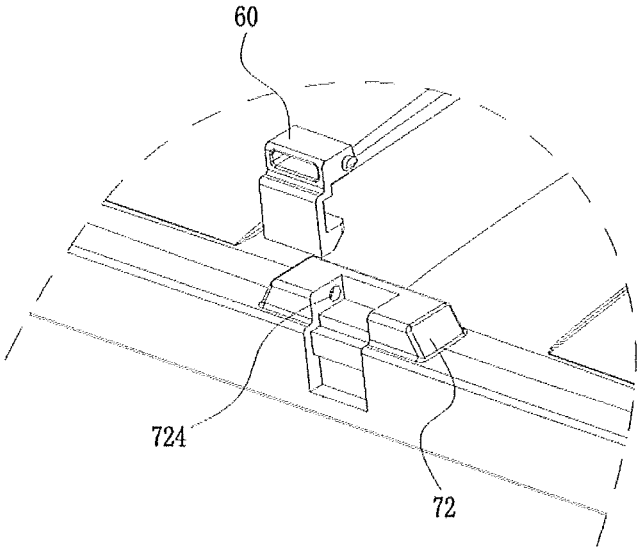
FIG. 13 is a partially exploded schematic view of the portion of the container cover provided with manual lock according to the third embodiment.
Figure 14:
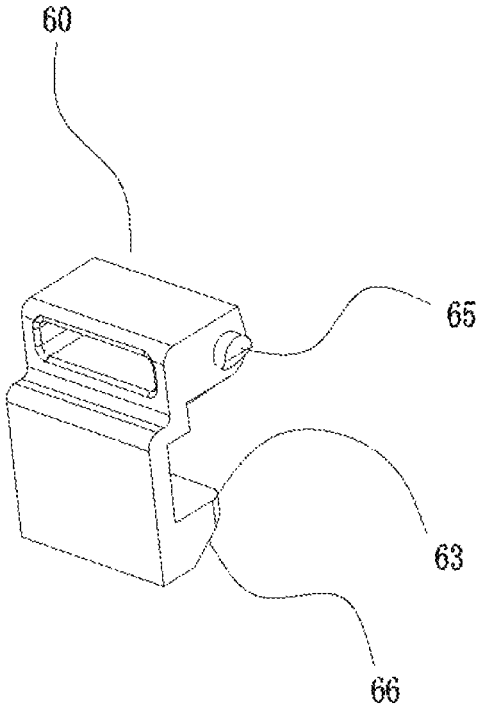
FIG. 14 is a perspective view of manual lock of the container according to the third embodiment.

With reference to FIG. 13 and FIG. 14, the third embodiment of the container according to the present invention is shown in figures. In the third embodiment, the guiding device of the manual lock comprises a pin 65, and a rotation hole 724 is provided in the boss 72. The pin 65 is rotatably connected to the rotation hole 724, and the pin 65 and the rotation hole 724 is slightly Interference fit with each other.

Figure 7:
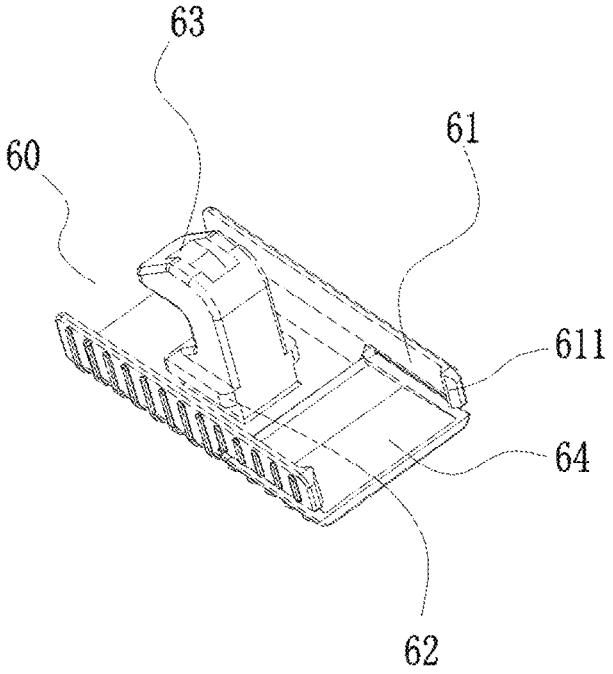
FIG. 7 is a perspective view of a manual lock of the container according to the first embodiment.
Figure 8:
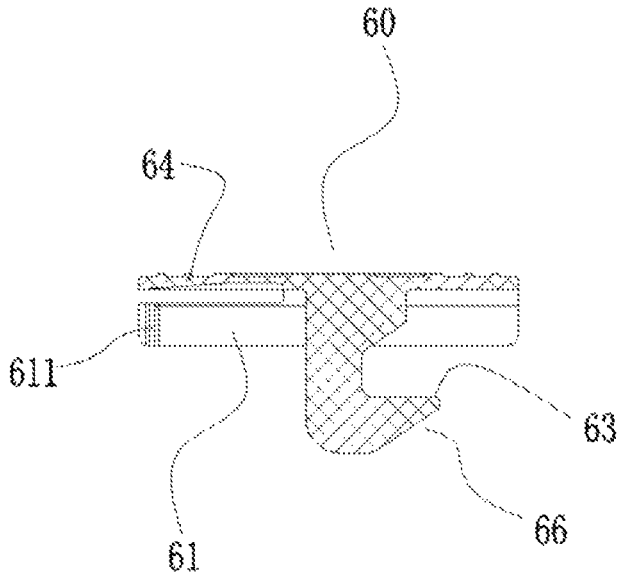
FIG. 8 is a longitudinal section view of the manual lock of the container according to the first embodiment.
Figure 9:
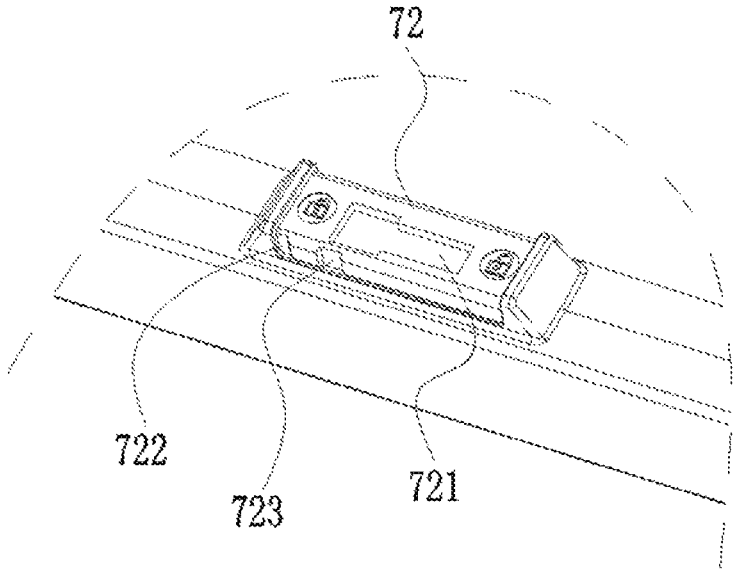
FIG. 9 is a partially schematic view of the portion of the container cover provided with boss according to the first embodiment.
Figure 10:
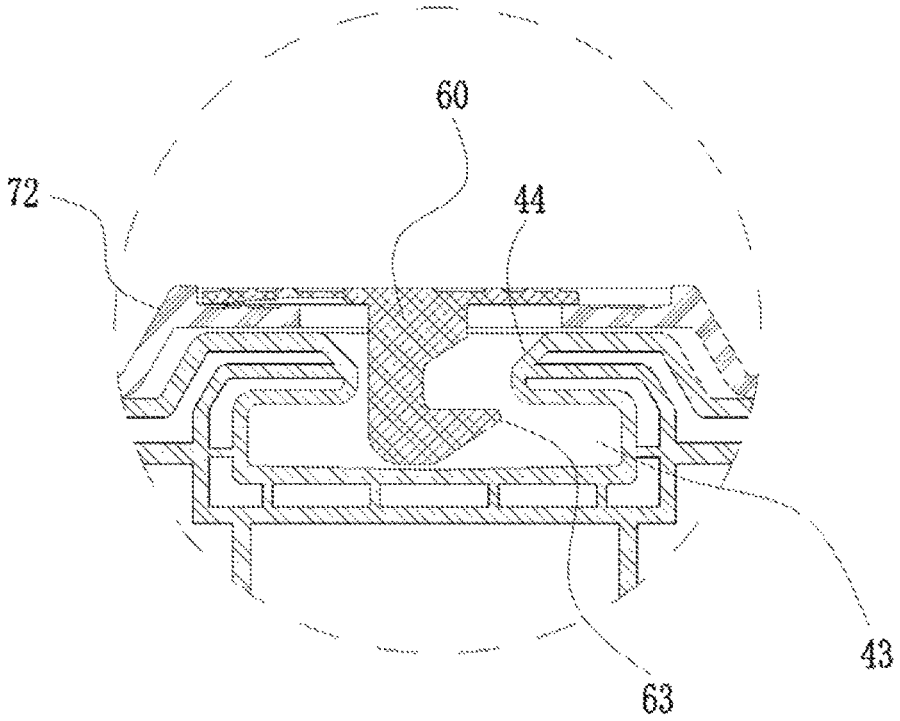
FIG. 10 is a cross-section view of the assembled manual lock of the container according to the first embodiment.

In the first embodiment, the combination of the slide step 62 and the slide groove 721, shown in FIG. 7 and FIG. 10, provides a linear moving guide for the locking operation of the manual lock. In the third embodiment, the combination of pin 65 and the rotation hole 724, shown in FIG. 13 and FIG. 14, provides a circumferential rotation guide for the locking operation of the manual lock.

It should be noted that the container of the present invention may simultaneously adopt the automatic lock and the manual lock structure provided in the first embodiment, and also may simultaneously adopt the automatic lock structure provided in the first embodiment and the manual lock structure provided in the third embodiment, and further may simultaneously adopt the automatic lock structure provided in the second embodiment and the manual lock structure provided in the third embodiment, and other combinations can be adopted. The inventive concept of the container according to the invention is that the automatic locks and the manual locks are both provided on the cover and used in cooperation with a tilting-prevention device, thus the container has the tilting-prevention effect, the stacking and supporting effect, and the locking and unlocking guiding and returning guiding effect.

Preferably, the volume of the container of the present invention is above 600 L, in particular above 700 L. Preferably, the container of the present invention refers to the container with the volume above 800 L.

The container of the present invention may adopt a folded or non-folded configuration. The container of the present invention may adopt such a structural design that the automatic lock or manual lock are provided on the one or more protrusions of the tilting-prevention devices, that is the locking device and the tilting-prevention devices are provided as a combination. Such a combination having both locking function and tilting-prevention function increases the overall aesthetic appearance of the container and improves the carrying capacity of the cover due to the reduced mounting area of the cover surface, increasing the contact area between the cover of the lower container and the base of the upper container.

It should be further noted that the cover of existing container is provided with only manual lock or automatic lock. The structural design provided with only manual lock or automatic lock has become the designing conventions of the cover for large container. However, if two opposite sides of the cover are provided with only the automatic lock or the manual lock, and the other sides are not provided with any locks, there exists risk of goods spilled from the sides without any locks. Furthermore, if four sides of the cover are provided with mere automatic lock, the unlock operation is inconvenient, and needs to be operated by multiple people together. If four sides of the cover are provided with mere manual lock, the unlock operation is relative complicated. In addition, no matter the manual lock or the automatic lock is generally not provided with the lock guiding device, so that the locking operation is unchanged and the lock is easily damaged.

While the preferred embodiments of the present invention have been described in detail, it should be understood that various modifications or changes may be made to the present invention by those skilled in the art after reading the above teachings of the present invention. These equivalent forms also fall within the scope of the appended claims of the present application.

What is claimed is:

1. A container, comprising:

a base;

a cover;

side plates connected to the base and the cover, wherein the cover is configured to be locked onto the tops of the side plates with automatic locks and manual locks, the automatic locks provided on two opposite sides of the cover, and the manual locks provided on the other two sides of the cover.

2. The container of claim 1, wherein the automatic locks and adjacent manual locks of the automatic locks can be connected to each other by a line to form a polygon shape whose adjacent side lengths are presented by A and B respectively, and $A \leq B \leq 1.5\ A$;

or the automatic locks and the adjacent manual locks can be connected to each other by a line and connected with side of the cover by a line to form a polygon shape whose adjacent side lengths are presented by C and D respectively, and $C \leq D \leq 1.5\ C$.

3. The container of claim 1, wherein the cover is further provided with a tilting-prevention device, and the tilting-prevention device is provided on the sides of the cover and corners of the cover are avoided.

4. The container of claim 1, wherein the cover is further provided with a tilting-prevention device, and the tilting-prevention device comprises multiple protrusions integrally extending upward from the sides of the cover, and the base is provided with recesses cooperating with the protrusions.

5. The container of claim 4, wherein one or more of the multiple protrusions is provided with the automatic locks or the manual locks.

6. The container of claim 1, wherein the manual locks are provided with a locking member and a guiding device, and the locking member can be guided by the guiding device to achieve locking or unlocking.

7. The container of claim 6, wherein the other two sides of the cover is further provided with bosses, and the manual locks are provided on the bosses, and lower surface of the base is provided with grooves cooperating with the bosses; wherein the guiding device comprises a slide step, and the bosses are provided with a sliding groove cooperating with the slide step, so that the slide step can be slidably mounted in the sliding groove; or the guiding device comprises a pin, and the bosses are provided with a rotation hole, and the pin can be rotartablely connected to the rotation hole.

8. The container of claim 7, wherein the locking member is provided with a locking hook, and the side plates are provided with a hook groove, and the locking hook can be locked and connected to the hook groove; two sides of the manual locks are further provided with side arms, and one end of the side arms is provided with a locking block, and a first locking slot and a second locking slot are provided on two sides of the bosses, and the locking block can be snapped in the first locking groove and the second locking groove so as to respectively achieve unlocking position and locking position.

9. The container of claim 1, wherein the automatic locks comprise a handle, and the handle is further provided with a resetting member, and the upper side of the cover is provided with a handle groove, and the handle is accommodated in the handle groove and the resetting member is elastically connected to a side wall of the handle groove; wherein the handle is provided with a connecting hole, and the handle groove is provided with a connecting shaft, and the connecting shaft can be rotartablely connected to the connecting hole; or the handle is provided with a hook, and the handle groove is provided with a hanging platform, and the hook is mounted on the hanging platform and can slide along the hanging platform.

10. The container of claim 9, wherein the handle is further provided with a pin member, and the automatic locks further comprise a latch, and the latch is provided with a guide track, a pin hole and a buckle, and the side plates are provided with a buckle groove, and the pin member can be cooperatively connected to the pin hole, and the buckle can be locked and connected to the buckle groove; and the sides of the cover are provided with a guide groove, and the slide can be slidably mounted into the guide groove.

* * * * *